US007240530B1

(12) United States Patent
Slaven, Jr.

(10) Patent No.: US 7,240,530 B1
(45) Date of Patent: Jul. 10, 2007

(54) AUXILIARY EMBOSSER

(76) Inventor: Leland Slaven, Jr., 6130 Turnbury Park Dr., #8103, Sarasota, FL (US) 34243

( * ) Notice: Subject to any disclaimer, the term of this patent is extended or adjusted under 35 U.S.C. 154(b) by 132 days.

(21) Appl. No.: 11/095,350

(22) Filed: Mar. 31, 2005

(51) Int. Cl.
*B21D 5/14* (2006.01)
*B21D 37/04* (2006.01)

(52) U.S. Cl. ..... 72/177; 72/182; 72/366.2

(58) Field of Classification Search ..... 72/177, 72/181, 379.2, 196, 182, 365.2, 366.2
See application file for complete search history.

(56) References Cited

U.S. PATENT DOCUMENTS 3,171,517 A * 3/1965 Howell ..... 52/86
3,710,607 A 1/1973 Beymer
4,020,666 A 5/1977 Beymer
4,343,171 A * 8/1982 Kagawa ..... 72/181
5,007,271 A * 4/1991 Boegli ..... 72/196
5,009,093 A * 4/1991 Quinn et al. ..... 72/177
5,038,592 A 8/1991 Knudson
5,394,722 A 3/1995 Meyer
5,724,776 A 3/1998 Meadows, Jr.
5,740,687 A 4/1998 Meyer et al.
6,314,685 B1 11/2001 Sullivan

FOREIGN PATENT DOCUMENTS

JP 1-202321 * 8/1989

* cited by examiner

*Primary Examiner*—Daniel C. Crane
(74) *Attorney, Agent, or Firm*—Charles J. Prescott

(57) ABSTRACT

An auxiliary embosser for use with a mobile or stationary on or off-site roll forming apparatus which roll forms sheet material into objects such as a rain gutter or aluminum siding having complex cross section profiles. The auxiliary embosser includes a frame adapted to be aligned and attached adjacent to the apparatus in relation to a roll formed object discharge thereof. The frame includes closely spaced mating embossing rollers held for rotation in the frame about spaced rotational axes and aligned to receive one surface of a roll formed object discharging from the apparatus. The embossing rollers are formed having a profile of their mating surfaces configured to be substantially similar to a profile of the one surface of the object and further include a decorative design which is embossed into the one surface of the object while being moved through the embossing rollers as controlled by the apparatus.

2 Claims, 5 Drawing Sheets

AUXILIARY EMBOSSER

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to stationary or mobile forming machines for producing metal siding and rain gutters and other elongated contoured metal objects for application to the exterior of buildings and structures and more particularly to an auxiliary embosser attachable to such mobile or stationary forming machines used on or off-site to form seamless rain gutters and aluminum siding members.

2. Description of Related Art

Aluminum or copper rain gutters and siding are typically formed from a sheet of rolled metal stock which is entrained through multiple roll sets. The respective surfaces are progressively shaped by the roll sets to provide interlockable profiles or rain gutter profile configurations as predetermined by the configuration of the roll sets. A typical machine utilized for this purpose is disclosed in U.S. Pat. No. 3,710,607.

It has been found beneficial to roll form these sections of aluminum siding, rain gutters and the like in a length exactly matching the length of a particular surface to which the roll formed object will be attached. These are sometimes referred to as "seamless" siding and rain gutters. To accomplish these seamless roll formed objects, portable equipment is brought to the work site and the required lengths of roll formed sections are fabricated from rolls of flat sheet metal stock which exactly match the work-building surface to which these objects will be attached.

Recently, embossing of an exposed surface of these roll formed objects has received a great deal of favor as it adds a very distinctive appearance to these exposed surfaces of buildings. Wood texturing and other embossing textures may be introduced as desired based upon available embossing rollers in the mobile apparatus which may also be interchanged at a work site to achieve a desired embossed decorative effect. One such apparatus intended for this purpose is disclosed by Beymer in U.S. Pat. No. 4,020,666. However, in this disclosure, the embossing rollers are incorporated into the apparatus adding cost and are difficult if not impossible to interchange without substantial dismantling of the apparatus itself.

Add-on decorative devices which include pre-embossed decorative exposed gutter surfaces and which are attachable to the exposed surface of a conventional rain gutter are disclosed by Meadows in U.S. Pat. No. 5,724,776 and Sullivan in U.S. Pat. No. 6,314,685.

A number of additional roll-forming machines utilized to roll form metal siding and rain gutters and the like are disclosed in the following U.S. patents.

U.S. Pat. No. 5,740,687 to Meyer, et al.
U.S. Pat. No. 5,394,722 to Meyer
U.S. Pat. No. 5,038,592 to Knudson
U.S. Pat. No. 6,439,020 to Baschnagel, III, et al.
U.S. Pat. No. 6,122,878 to Pliley
U.S. Patent D462,790 to Bullinger, et al.

The present invention provides an auxiliary embosser which is readily adapted for attachment to the gutter or object discharge portion of a conventional mobile or stationary roll forming apparatus such as that disclosed in U.S. Pat. No. 6,020,666. More specifically, the present invention is readily attachable to the discharge end of the roll forming equipment manufactured by New Tech Machinery Corp. of Denver, Colo. and Jobsite, Inc. of Grand Junction, Colo.

Thus, by the present invention, existing seamless mobile or stationary roll forming equipment may be readily adapted to apply a decorative embossing to expose surfaces of roll-formed objects at a worksite or manufacturing facility without the need for additional roll-forming equipment and expense associated therewith.

BRIEF SUMMARY OF THE INVENTION

This invention is directed to an auxiliary embosser for use with a mobile or stationary, on or off-site roll forming apparatus which roll forms sheet material into objects such as a rain gutter or aluminum siding having complex cross section profiles. The auxiliary embosser utilizes existing rolling equipment to feed material through the embosser unit and includes a frame adapted to be aligned and attached adjacent to the apparatus in relation to a roll formed object discharge thereof. The frame includes closely spaced mating embossing rollers held for rotation in the frame about spaced rotational axes and aligned to receive one surface of a roll formed object discharging from the apparatus. The embossing rollers are formed having a profile of their mating surfaces configured to be substantially similar to a profile of the one surface of the object and further include a decorative design which is embossed into the one surface of the object while being moved through the embossing rollers as controlled by the apparatus.

It is therefore an object of the invention to provide an auxiliary embosser attachable to an existing on or off-site mobile or stationary roll-forming apparatus.

Yet another object of the invention is the economical addition of embossment to seamed or seamless rain gutters and aluminum siding.

Still another object of this invention is to provide an economical embosser for seamless objects which may be easily exchanged with various embossment roller designs to achieve endless embossment patterns.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
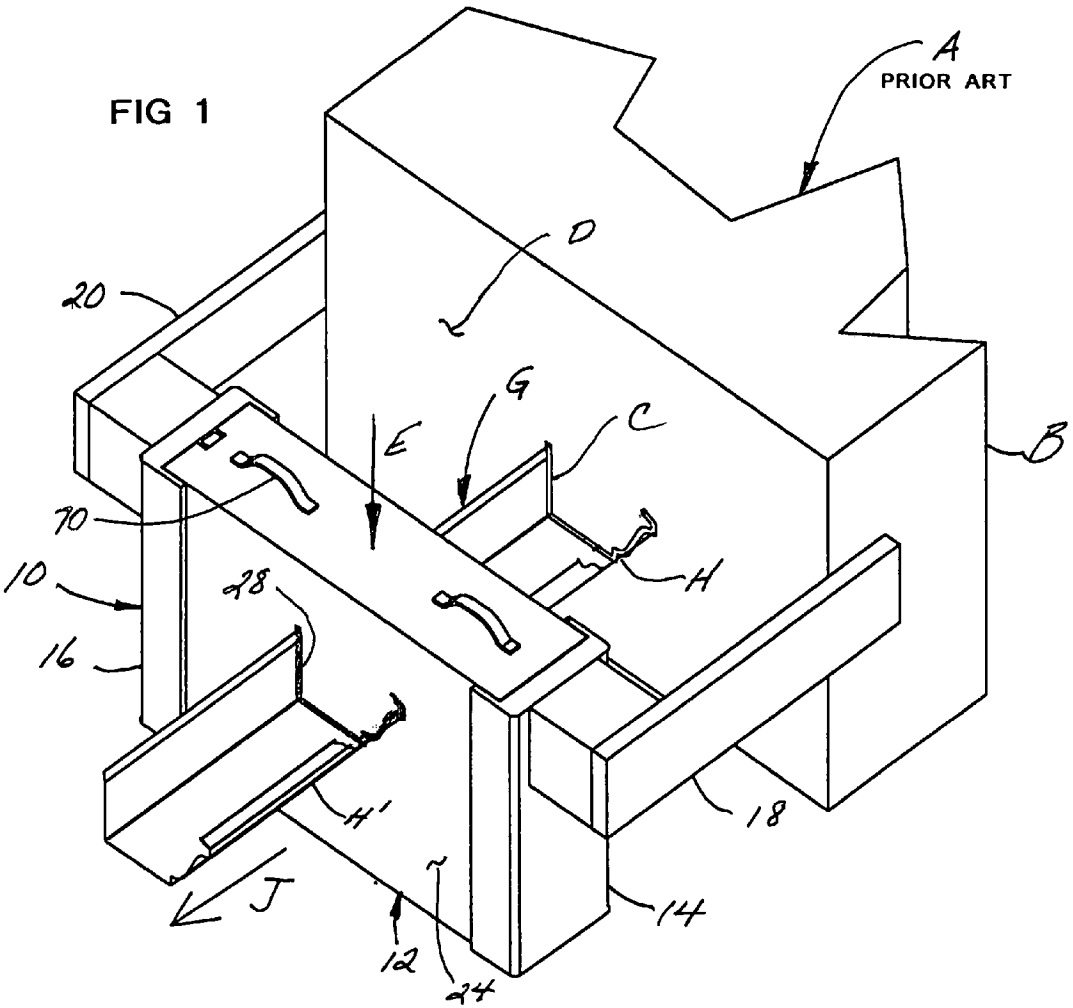
FIG. 1 is a perspective view of the invention attached in spaced relationship to the discharge end of a conventional mobile roll-forming apparatus.

Referring now to the drawings, the invention is there shown generally at numeral 10 and includes an auxiliary embosser shown generally at numeral 12 and spaced apart support arms 18 and 20 which are themselves attachable by fasteners at the distal ends thereof to the side surfaces of the discharge portion B of a conventional mobile or stationary roll-forming apparatus A referred to as being found in prior art. The length of rain gutter G discharges from a contoured slot or channel C formed into the discharge surface D of the roll-forming apparatus A.

Figure 2:
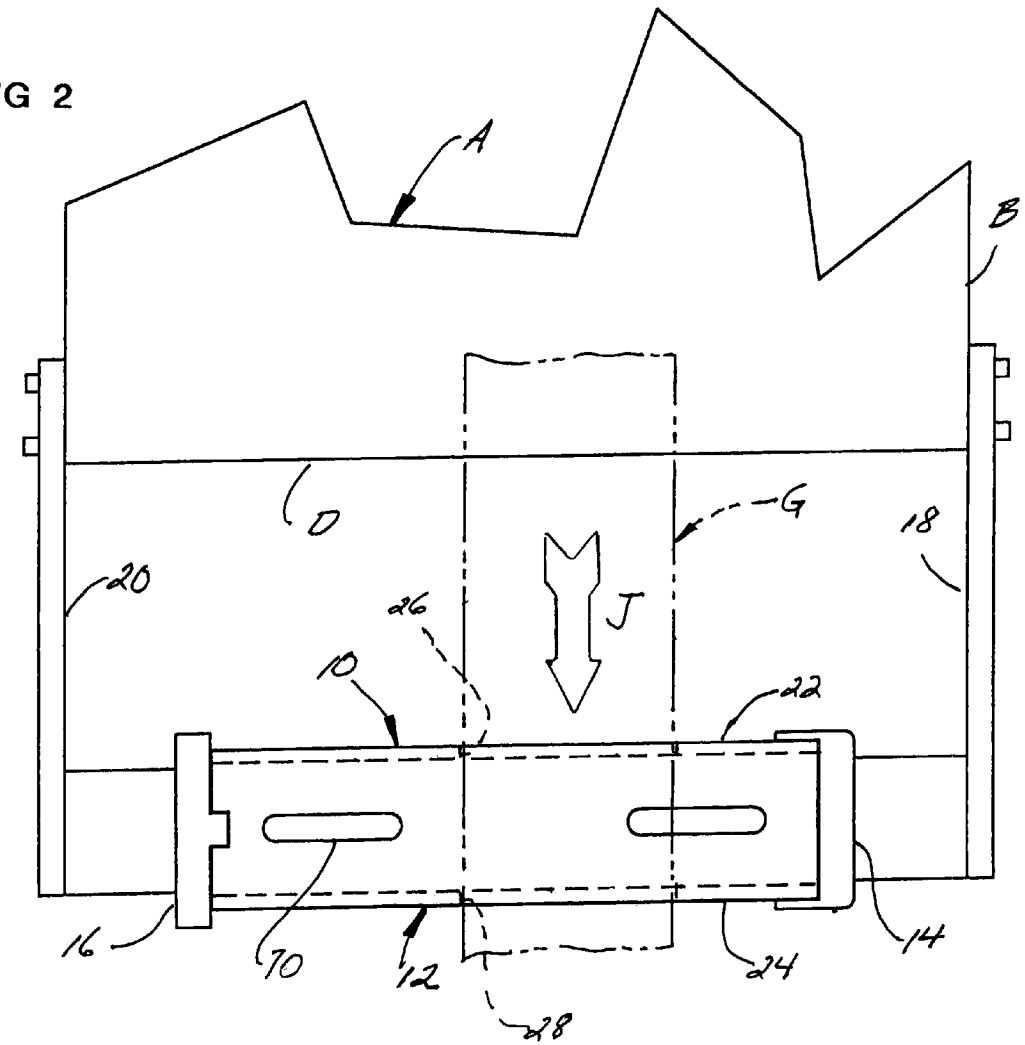
FIG. 2 is a top plan view of FIG. 1.

The auxiliary embosser 12 is slidably engageable into operative position downwardly in the direction of arrow D into U-sectioned support channels 14 and 16 which are rigidly connected to the support arms 18 and 20 as best seen in FIGS. 1 and 2. Handles 70 attached to the top surface of the embosser 12 facilitate this installation and removal of the embosser 12 as needed or in situations where the embossing rollers described herebelow are to be changed to impose a different decorative embossing pattern.

With the auxiliary embosser 12 positioned securely as shown, as the roll-formed gutter G emerges from the discharge slot C formed into the end surface D of the mobile or stationary roll-forming apparatus A in the direction of arrow J, the distal end of the gutter G is aligned with entrance and discharge guide slots or channels 26 and 28 formed into the respective spaced panels 22 and 24 of the auxiliary embosser 12. These slots or channels 26 and 28 are identical one to another and to the rolled profile configuration of the gutter G and in co-alignment one to another. Thus, as the gutter G emerges from the mobile or stationary roll-forming apparatus A, it is driven through the guide slots or channels 26 and 28 in the direction of arrow J by power applied within the mobile or stationary roll-forming apparatus A itself and its internal drive mechanism which propels the sheet material from beginning to end therethrough.

Figure 3:
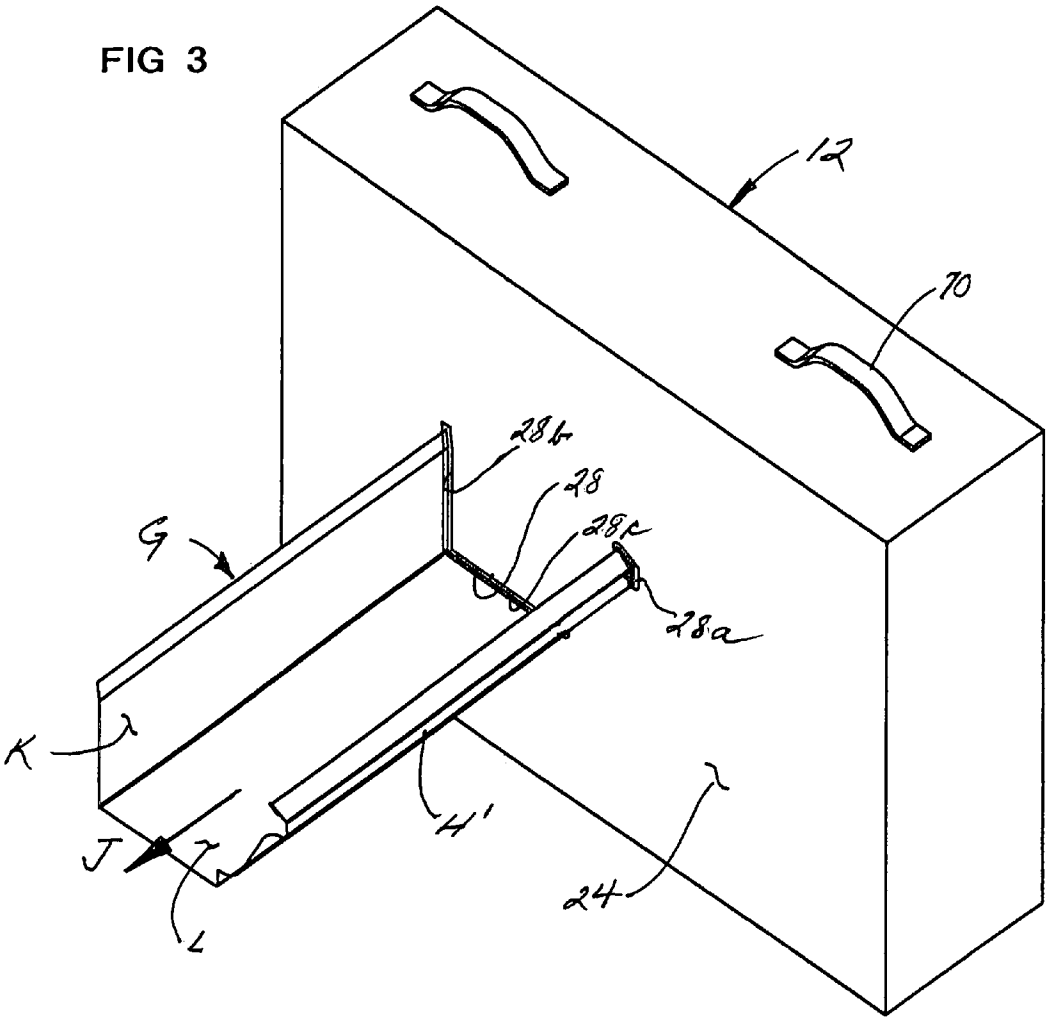
FIG. 3 is a perspective view of the invention showing a roll formed section of rain gutter discharging therefrom.
Figure 4:
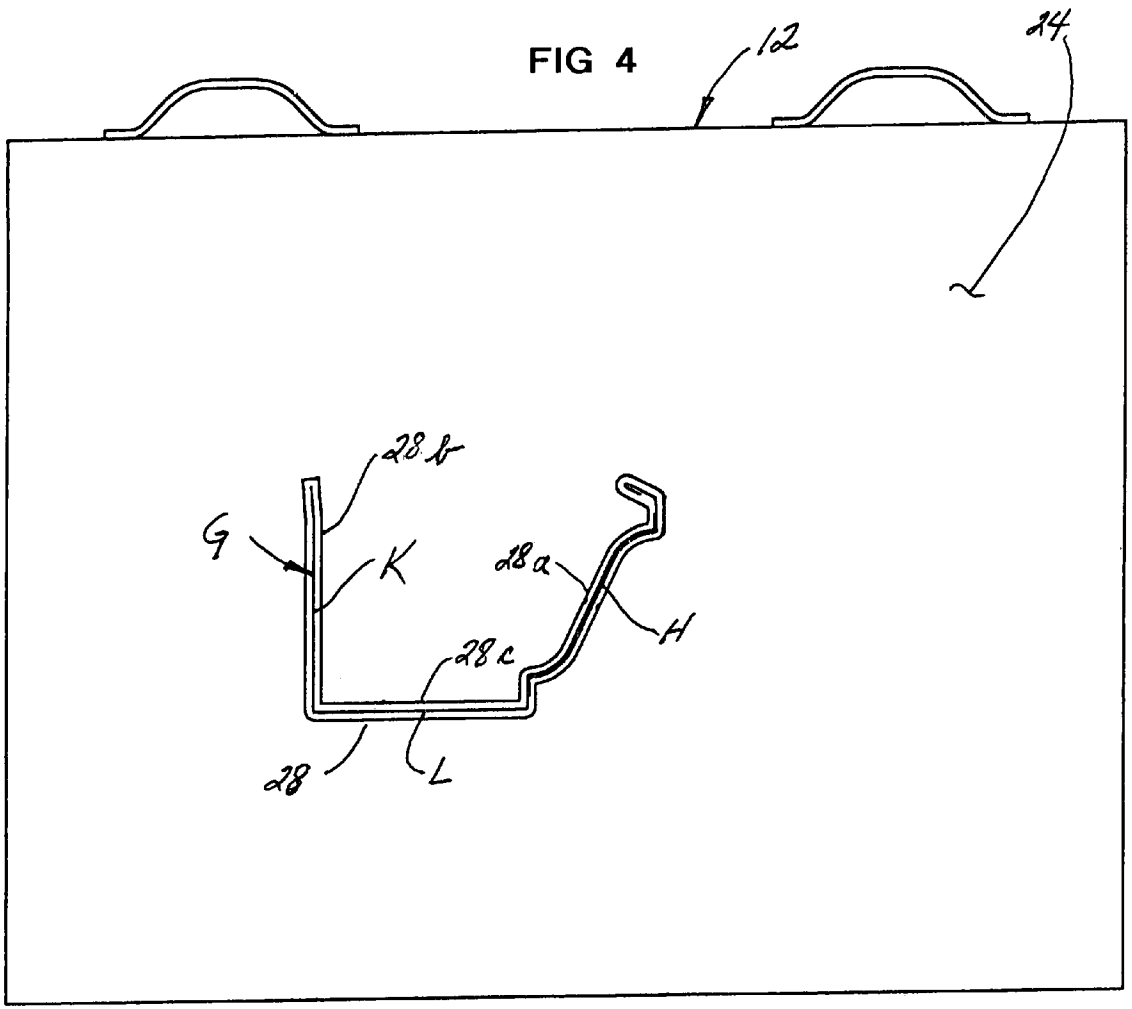
FIG. 4 is an elevation view of the discharge side of the invention.

Again, the slots or channels 26 and 28 are identical and aligned one to another in spaced relationship to receive the cross sectional profile of the gutter G and, as seen in FIGS. 3 and 4, include an upright back segment 28*b*, a bottom segment 28*c* and a decorative front segment 28*a* which correspond to the back, bottom and front contoured sections K, L and H, respectively, of the roll-formed gutter G. The present invention only acts upon and embosses in its preferred embodiment the front surface H of the gutter G.

Figure 5:
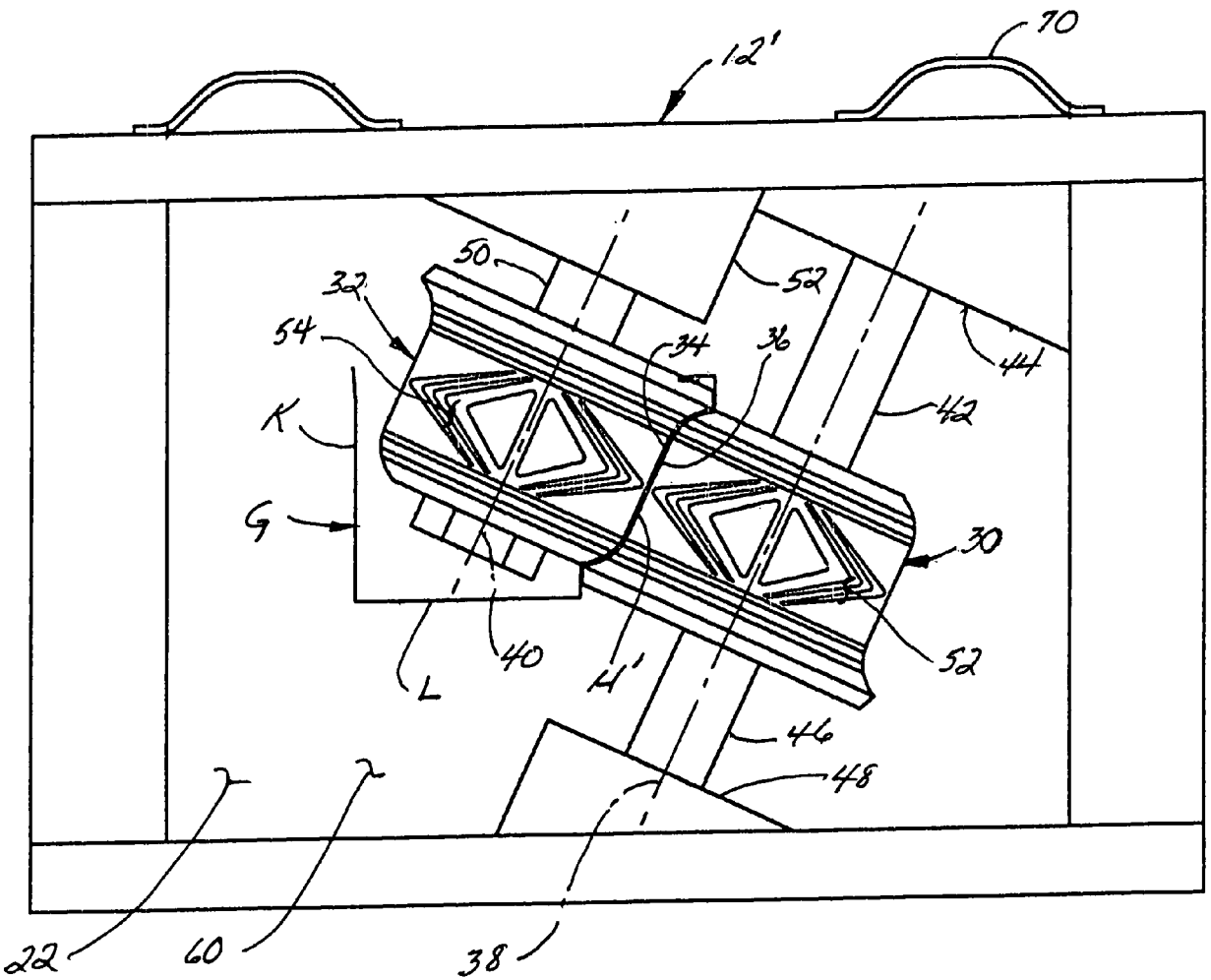
FIG. 5 is a view similar to FIG. 4 with the discharge panel removed.

Referring particularly to FIG. 5, the auxiliary embosser shown generally at 12' with the discharge panel 24 removed for clarity, houses two mating embossing rollers 30 and 32 which are held in close aligned relationship of the exterior contours 34 and 36, respectively, about rotational axes 38 and 40 on shafts 42/46 and 50, respectively within the interior volume 60. The profiles 34 and 36 of the embossing rollers 30 and 32, respectively, are contoured to substantially match the contour or the front surface H of the gutter G. Only a small clearance gap is provided between the embossing rollers 30 and 32 so that the mating decorative design 52 and 54 which has been machined into each of the profile surfaces 34 and 36, respectively, matably engage against the inner and outer surface of the front portion H of the gutter G so as to impose a pre-selected decorative embossing pattern into that surface as it emerges at H' bearing the decorative embossing as shown at 52 and 54 in FIG. 3, the gutter G emerging from the embosser 12 through the discharge slot or channel 28 as previously described.

By this arrangement, a wide variety of decorative embossing designs may be incorporated into interchangeable embossing rollers housed within different auxiliary embossers and may be interchanged quickly as desired and as previously described to achieve a wide variety of pre-established embossing designs which are embossed into the front surfaces H of gutters G on site as each length of seamless gutter is formed by the combination of the mobile or stationary roll-forming apparatus A and the auxiliary embosser 12.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. An interchangeable self-contained auxiliary rain gutter embosser for use with a mobile or stationary rain gutter roll forming apparatus, comprising:

a self-contained enclosure including a frame slidably engageable into spaced support arms adapted for attachment to the apparatus in a predetermined relation to a roll formed rain gutter discharge of the apparatus;

said frame including closely spaced mating embossing rollers held for free rotation on said frame about spaced axes of rotation and positioned on said frame to receive a front surface of the rain gutter discharging from the apparatus;

said embossing rollers formed having a profile of the mating surfaces configured to be substantially similar to a profile of the front surface of the rain gutter and including a decorative design which is embossed into the front surface of the object while being moved through the embossing rollers as controlled only by and after being discharged from the apparatus;

said enclosure including first and second spaced panels positioned on either side of said rollers, and attached to said frame so that said panels, rollers and frame form said self-contained enclosure which is interchangeable as a unit on the apparatus, each said panel having a guide slot or channel formed there through substantially matching and in alignment with the profile of the rain gutter passing through said embosser.

2. An auxiliary self-contained rain gutter embosser for use with a rain gutter roll forming apparatus, comprising:

a self-contained enclosure including a removable frame slidably engageable into spaced support arms adapted for attachment to the apparatus in a predetermined relation to a roll formed rain gutter discharging from the apparatus;

said frame including closely spaced mating embossing rollers held for free rotation on said frame about spaced axes of rotation and positioned on said frame to receive a front surface of the rain gutter which discharges from the apparatus;

said embossing rollers formed having a profile of the mating surfaces configured to be substantially similar to a profile of the front surface of the rain gutter and including a decorative design which is embossed into the front surface of the rain gutter while being moved through the embossing rollers by and after being discharged from the apparatus;

said enclosure including first and second spaced panels are attached to said frame so that said panels, rollers and frame form said self-contained enclosure which is removable as a unit from the apparatus, each said panel having a guide slot or channel formed there through substantially matching and in alignment with the profile of the rain gutter passing through said embosser, said first panel being positioned on one side and upstream of said embossing rollers, said second panel being positioned on the other side and downstream of said embossing rollers, said guide slots adapted for guiding the rain gutter into and through said enclosure.

* * * * *